United States Patent [19]

Farace et al.

[11] Patent Number: 4,848,234

[45] Date of Patent: Jul. 18, 1989

[54] TURNS-TO-ARM SENSOR

[75] Inventors: Louis P. Farace, Mesa; Monty W. Bai, Scottsdale; Jerry R. Whittaker, Scottsdale, all of Ariz.

[73] Assignee: Motorola, Inc., Schaumburg, Ill.

[21] Appl. No.: 177,555

[22] Filed: Apr. 4, 1988

[51] Int. Cl.[4] ..... F42C 15/40

[52] U.S. Cl. ..... 102/221

[58] Field of Search ..... 102/206, 210, 221, 262, 102/264

[56] References Cited

U.S. PATENT DOCUMENTS 3,192,412 6/1965 Stewart et al. ..... 102/264

3,750,583 8/1973 White et al. ..... 102/221

3,853,062 12/1974 Cole ..... 102/206

*Primary Examiner*—Charles T. Jordan

*Attorney, Agent, or Firm*—Maurice J. Jones

[57] ABSTRACT

A turns-to-arm sensor which uses a piezoelectric crystal to produce a current flow dependent upon the spin rate of a projectile. An output voltage is produced across a diode, from said current, which is proportional to the square root of the voltage at the crystal. The output voltage is approximately equal to the angular velocity of the projectile and is converted to frequency. The frequency determines the rate at which a preset counter operates. At time-out of the counter an arming signal is sent.

9 Claims, 1 Drawing Sheet

TURNS-TO-ARM SENSOR

BACKGROUND OF THE INVENTION

This invention pertains to a device and method for determining the revolutions of a spin stabilized projectile and subsequently arming a safety and arming device a fixed number of turns after firing.

In spin stabilized projectiles such as artillery shells, it is desirable that arming of the projectile takes place at a specific distance from the gun barrel. One method used in the prior art is a fixed time delay. After a predetermined fixed time, the projectile is armed. Because artillery shells from different sized guns, as well as the same gun can have widely differing velocities, the arming distance of the shells will undesirably vary with the velocity thereby creating a potentially dangerous situation.

To overcome this problem, devices have been developed which determine the distance the projectile has traveled by detecting the number of turns made by the projectile. Since the distance and rotation of the projectile are related linearly, this provides a distance-sensing function indirectly. Many of the devices presently in use employ mechanical means to determine the distance the projectile has traveled. U.S. Pat. No. 3,853,062 entitled "Device for Measuring Distance of Travel by a Projectile" issued Dec. 10, 1974, uses a pendulum inside the fuze of a spin stabilized projectile. One complete swing of the pendulum is equal to or proportional to one complete revolution of the spinning shell. The distance traversed by the projectile is determined from reading the number of complete cycles made by the pendulum which, in turn, is equal to the number of revolutions of the spinning shell. While this device and other mechanical devices of like nature produce the desired results, they are mechanically complex and have moving parts which increase the chance of failure and increase the cost of the device.

Electromechanical devices have also been developed which determine the distance the projectile has traveled and set a time delay. Some of these devices employ digital threshold acceleration switches in conjunction with a microprocessor. While these devices can determine the distance traveled by the projectile with a varying degree of accuracy, the device has moving parts and is complex causing increased cost and reliability problems.

SUMMARY OF THE INVENTION

The present invention relates to a turns-to-arm sensor which uses a means for generating a current proportional to the centrifugal force created by the rotation of a spin stabilized projectile. The current flow in a circuit connected to the means for producing a current flow induces a voltage drop across a semiconductor diode. This voltage drop is then used to drive a voltage-to-frequency converter which paces a counter until the preset number of counts is achieved. The time-out of the counter can be adapted to the spin speed of the projectile such that a constant number of turns of the projectile takes place during the time-out period independent of the velocity of the projectile.

Accordingly, it is an object of the present invention to provide an improved turns-to-arm sensor.

A further object of the present invention is to provide a device which will supply an arming signal for a variety of spin stabilized projectiles at a constant number of projectile revolutions and thus a constant distance.

Another object of the present invention is to provide a simple, low cost turns-to-arm sensor.

These and other objects of this invention will become apparent to those skilled in the art upon consideration of the accompanying specification, claims and drawings.

DESCRIPTION OF THE PREFERRED EMBODIMENT

It is desirable to arm a fuze or activate a safety and arming device in spin stabilized projectiles at safe distances from the gun muzzle. For reasons of safety, a consistent arming distance is required. Since an artillery shell can be fired at a variety of velocities, in the present invention the anglular velocity ($\omega$) is used to measure the distance a projectile has traveled.

Figure 1:
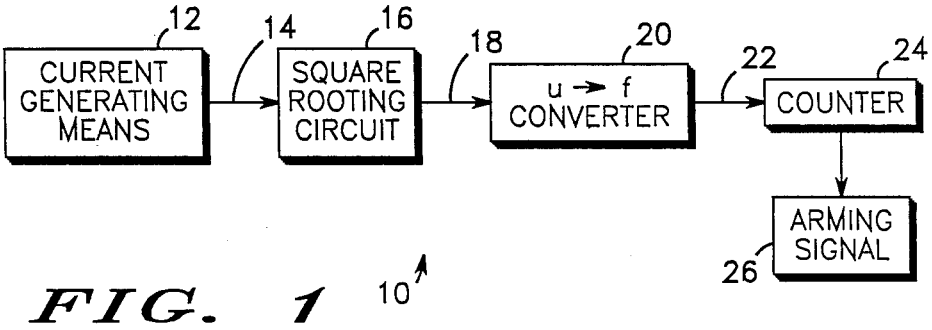
FIG. 1 is a simplified block diagram embodying the present invention.

FIG. 1 is a simplified block diagram illustrating an embodiment of the present invention. A turns-to-arm sensor generally designated 10 comprises a current generating means or sensor 12 which generates a current across its internal resistance such that $$V_{CR} \approx K\omega^2$$

where $V_{CR}$ equals the sensor voltage, $\omega$ equals angular velocity and K is a constant. The current generating means may be an accelerometer or any device which would produce a current that is proportional to the centrifugal force exerted by the spinning projectile. In the preferred embodiment, current generating means 12 is a piezoelectric crystal. Current generating means 12 has an output 14 which is coupled to a square root circuit 16. The current flow from current generating means 12 induces a voltage drop across a semiconductor diode in square root circuit 16 in the preferred embodiment. Thus, $$V_O \approx V_{CR} \approx \omega C$$

where C is a constant. Square root circuit 16 has an output 18 coupled to a voltage-to-frequency converter 20. Converter 20 converts voltage ($V_O$) to a precalibrated frequency. Converter 20 has an output 22 coupled to a counter 24. The frequency from voltage-to-frequency converter 20 paces counter 24 until the present number of counts is achieved. When the time-out of the counter is reached, an arming signal 26 is sent to a safety and arming device.

Figure 2:
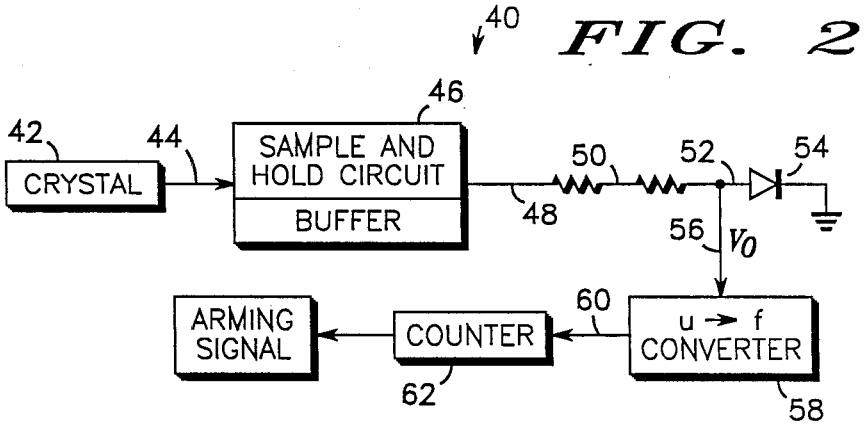
FIG. 2 is a schematic drawing illustrating an embodiment of the present invention.

FIG. 2 is a schematic diagram illustrating a turns-to-arm sensor generally designated 40 embodying the present invention and showing blocks 12, 16 and 20 of FIG. 1 in more detail. A centrifugal force produced by the spinning of the projectile is exerted upon crystal 42 producing a current flow. A piezoelectric crystal 42 generates a current across internal resistance developing a crystal voltage ($V_{CR}$). Thus, $$V_{CR} \approx F = K\omega^2$$

where F is the force exerted upon crystal 42. An output 44 of crystal 42 is coupled to a sample and hold circuit 46. Sample and hold circuits are well-known to those skilled in the art and may include a buffer to provide a drive signal. In output 48 of sample and hold circuit 46 is coupled to a temperature compensation circuit 50. Temperature compensation circuit 50 is well-known to those skilled in the art and may consist of temperature dependent resistors. Output 52 of temperature compensation circuit 50 is coupled to a diode 54. Diode 54 in this embodiment is a silicon diode. The current flow from temperature compensation circuit 50 induces a voltage drop across a semiconductor diode 54. The output voltage ($V_O$) is approximately equal to the square root of $V_{CR}$. Thus, $$V_O \approx \omega C$$

Figure 3:
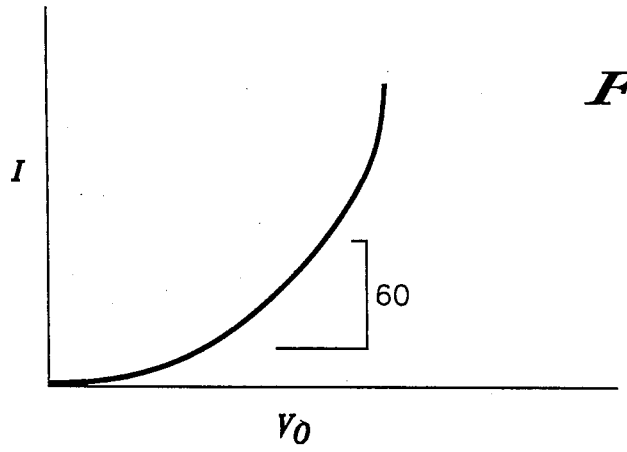
FIG. 3 is a graph of the characteristics curve of a semiconductor diode.

FIG. 3 shows the characteristics curve of a semiconductor diode. The x-axis is the output voltage, the y-axis is the current flow. Knee portion 60 of the curve is the range desired, and is known to be a square function. The piezoelectric crystal is designed to operate within portion 60 of the curve, thus achieving the desired results. Output 56 of silicon diode 54 is coupled to a voltage-to-frequency converter 58. An output 60 of converter 58 is coupled to counter 62. The frequency produced by converter 58 now paces the counter 62 which has a preset number of counts depending upon the arming distance required. When time-out of the counter is reached, an arming signal 64 is sent to the safety and arming device.

It can be shown that this device adapts the time-out of the counter to the spin speed of the projectile such that a constant number of turns of the projectile takes places during the time-out period.

Thus, a turns-to-arm sensor has been developed which is completely electronic, having no moving parts and is thus simple and inexpensive to produce. Also, the use of centrifugal force to determine the distance covered by the projectile allows a safing and arming device to be activated at a substantially equal, predetermined distance from the gun.

Having thus described the invention, it will be apparent to those of skill in the art that various modifications can be made within the spirit and scope of the present invention. For example, while a piezoelectric crystal was used in the preferred embodiment, an accelerometer may be used, although a piezoelectric crystal would be simpler and less expensive. Further, while a silicon diode was used to perform the square root function, any device which would provide the same results may be used. There are many circuits which are known to those skilled in the art which would perform the square root function although the use of the diode is believed to be the simplest and least expensive.

I claim:

1. A turns-to-arm sensor comprising:

means for generating a current flow having an output;

square root means coupled to said output of said means for generating, said square root means for inducing a voltage drop proportional to the square root of said current flow from said means for generating and having an output;

voltage-to-frequency converter coupled to said output of said square root means and having an output;

a frequency paced counter coupled to said output of said voltage-to-frequency converter and having an output; and means for sending an arming signal coupled to said output of said counter when said counter reaches time-out.

2. A device as claimed in claim 1 wherein said means for generating a current flow is a piezoelectric crystal.

3. A device as claimed in claim 1 wherein said means for generating a current flow is an accelerometer.

4. A device as claimed in claim 1 wherein said square root means further comprises a semiconductor diode.

5. A turns-to-arm sensor comprising:

means for generating a centrifugal force dependent current flow having an output;

a sample and hold circuit with an input coupled to said output of said means for generating and having an output;

a temperature compensation circuit having an input coupled to the output of said sample and hold circuit and having an output;

square root means for inducing a voltage drop proportional to the square root of said current from said means for generating with an input coupled to said output of said temperature compensation circuit and an output;

voltage-to-frequency converter having an input coupled to said output of said square root function and having an output;

a frequency paced counter having an input coupled to said output of said voltage-to-frequency converter and an output; and means for generating an arming signal when said counter reaches time-out having an input coupled to said output of said counter and having an output.

6. A device as claimed in claim 5 wherein said means for generating a current flow is a piezoelectric crystal.

7. A device as claimed in claim 5 wherein said means for generating a current flow is an accelerometer.

8. A device as claimed in claim 5 wherein said square root means further comprises a semiconductor diode.

9. A method for determing turns-to-arm comprising:

providing a centrifugal force;

generating a current flow dependent upon said centrifugal force;

generating a voltage proportional to the square root of said current flow;

converting said voltage to a frequency;

decrementing a preset counter at a rate dependent upon said frequency; and generating an arming signal upon time-out of said counter.

* * * * *